United States Patent [19]

Foy

[11] Patent Number: 4,694,531

[45] Date of Patent: Sep. 22, 1987

[54] SUSPENDED OVERHEAD HOLLOW TRACK SUPPORT SYSTEM

[76] Inventor: Peter S. Foy, 4345 Topaz St., Las Vegas, Nev. 89121

[21] Appl. No.: 781,335

[22] Filed: Sep. 30, 1985

[51] Int. Cl.[4] ..... A47H 1/04

[52] U.S. Cl. ..... 16/87.4 R; 16/94 R; 16/95 R; 104/111

[58] Field of Search ..... 16/94 R, 94 D, 95 R, 16/95 W, 95 D, 95 DW, 96 R, 96 D, 96 L; 104/94, 107, 108, 109, 111

[56] References Cited

U.S. PATENT DOCUMENTS

| | | | |
|---|---|---|---|
| 509,650 | 11/1893 | Brodie | 16/94 R |
| 1,215,084 | 2/1917 | Van Dventer | 16/95 R |
| 3,468,509 | 9/1969 | Foltz | 16/94 R |
| 3,879,799 | 4/1975 | Williams | 16/95 R |

FOREIGN PATENT DOCUMENTS

| | | | |
|---|---|---|---|
| 1191544 | 4/1959 | France | 16/94 R |
| 594186 | 5/1959 | Italy | 16/94 R |
| 624185 | 5/1949 | United Kingdom | 16/95 R |

*Primary Examiner*—Fred Silverberg
*Attorney, Agent, or Firm*—Roger A. Marrs

[57] ABSTRACT

A coupler for structurally joining opposing ends of overhead support rails is disclosed herein having a pair of elongated splice plates carried on opposite sides of the rail ends so as to overlap the abutment of the ends. Each splice plate of the pair is of substantially uniform cross section having a U-shaped channel section including a central, upright web terminating in transverse, parallel flanges. The upper flange is integrally formed with an upwardly extending flange parallel to but spaced apart from the upright web. Trapezoidal ribs extend externally of the channel section in parallel spaced relationship along the upper flange immediately adjacent to the web and along the web midway between the transverse flanges. Threaded bores provided in the ribs insertably receive fasteners for bearing against the respective rails. The configuration of each splice plate is conformal with the external configuration of the overhead support rails.

1 Claim, 3 Drawing Figures

SUSPENDED OVERHEAD HOLLOW TRACK SUPPORT SYSTEM

BACKGROUND OF THE INVENTION

1. Field of the Invention

This invention relates to an overhead support system and is, more particularly, concerned with such a system for use in theatres to provide an overhead suspension track for curtains or other suspended apparatus or people.

2. Brief Description of the Prior Art

In known overhead track systems, open-ended elongated track or rail members of box-like section have been employed using an elongated slot extending along a lower side and formed of folded steel sheet metal to provide a rigid elongated support member within which pulley support means may run with a suspension support downwardly depending therefrom through the slot. Curtains, stage props or other theatrical apparatus is attached to the suspension support whereby movement of the pulley support means carries the curtains, props or apparatus along the path determined by the track or rail member.

Difficulties and problems have been encountered in joining adjacent ends together of track or rail member sections in order to provide a pulley support means path longer than the length of a single track or rail member. Usually, a coupler is used to connect the opposing ends of track members in proper alignment to permit smooth travel of the pulley support means. The conventional coupler comprises a pair of splice plates positioned on either side of the abutting opposing ends of track members so as to reinforce the joint. Each splice plate comprises an upper flange formed with a lower portion of half box-form such that when the upper flange portions of a pair of are abutted the half-box portions may embrace the box-like section of the track or rail member. These latter portions include lower facing edges of the half-box portions being spaced apart sufficiently to avoid obstructing the slot of the track member. The splice members are assembled by bolts passing through the abutting flange portions, and the sides of the half-box portions are provided with an array of threaded apertures into which bolts are screwed for engaging the external surfaces of the track member to secure it therein. The splice plates are formed from folded, steel sheet metal pieces and the half-box portions provide a large clearance fit around the track member box-section. The bolts in the threaded apertures serve to take up the clearance and to center the track member such that two track members may be substantially precisely aligned within the splice. This is time consuming and requires skill and care to avoid obstruction in use due to slight misalignment of the track members. The large number of bolts required presents difficulties in assembly, storage and transport of a support system comprising a multiplicity of track members and splices and also present external projections in assembled use which may present hazards to lines, ropes, chains or the like used with the system for supporting and traversing purposes. Also, by constructing the splice plate from sheet steel, the joint is not sufficiently reinforced to prevent wobble during movement of the pulley support means. Although the use of steel would seem to be strong, the opposite is true since the form of metal is sheet. The use of steel is heavy and does not constitute a high strength-to-weight ratio.

Therefore, a long standing need exists to provide a coupling means for abutting opposing ends of aligned track or rail members which is lightweight, strong and convenient to transport as well as to install.

SUMMARY OF THE INVENTION

Accordingly, the above problems and difficulties are obviated by the present invention which provides a novel coupling means for jointing the aligned ends of shaped and slotted track or rail members comprising a pair of splice plates conformal with the shaped track or rail members wherein each splice plate is characterized as having a U-shaped channel consisting of a central web with transverse end flanges. An upwardly extending flange is provided on the upper end flange while the lower end flange terminates at one side of the track or rail member slot. The splice plate is further characterized as being of one piece unitary construction of integral uniform cross-section and mounting reinforcing ribs or stiffeners on the central web as well as the upper end flange. Mounting means include threaded apertures and mated fasteners for aligning and securing the splice plates to the track or rail members. Also, a feature resides in the utilizing a high strength-to-weight ratio metal composition such as aluminum for splice plate construction.

Therefore, it is among the primary objects of the present invention to provide a novel coupler for joining abutting sections of overhead track that is rigid and reinforced as well as being conformal to the shape of the track.

Another object of the present invention is to provide a novel coupler compised of high strength-to-weight ratio composition configured to mate with the shape of an overhead rail or track and which avoids catching or hang-up of lines, pulley cords or the like.

Still another object of the present invention is to provide a reinforced coupler for joining abutting ends of overhead rail sections that may be readily installed by unskilled persons without special tools or equipment.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by reference to the following description, taken in connection with the accompanying drawings in which:

DESCRIPTION OF THE PREFERRED EMBODIMENT

Figure 1:
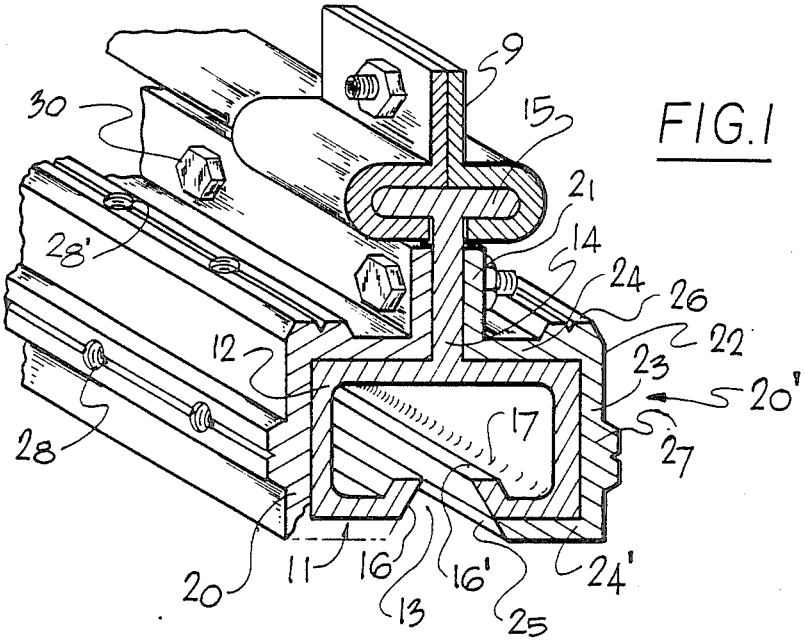
FIG. 1 is a transverse cross-section view, in perspective, of a conventional overhead track member employing the novel coupler of the present invention.
Figure 2:
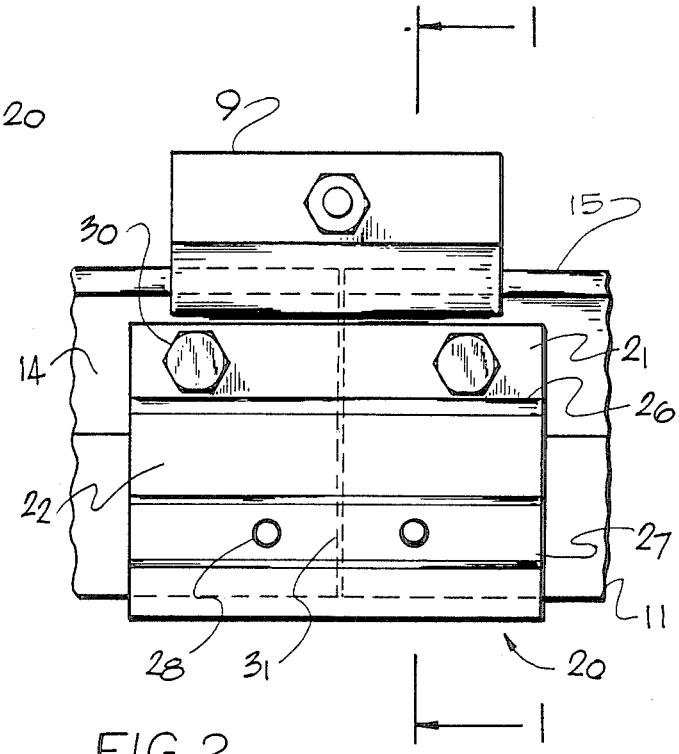
FIG. 2 is a side elevational view of the coupler and track member shown in FIG. 1.

Referring now to FIGS. 1 and 2, an overhead track member 11 is illustrated which may be of any predetermined length which comprises an open-ended lower box-section 12 of generally square form and having a longitudinal central slot 13 formed in its lower side and extending from end-to-end of the member 11. An upright flange 14 extends centrally of the upper side of section 12 from end-to-end of member 11 and is formed with an upper transverse flange 15 in T-shape manner. The member is of unitary nature being integrally formed for example as an aluminum extrusion. Opposed angular edges 16 and 16' of box-like section 12 at opposite sides of slot 13 are turned up at an inclination and inner corners 17 of the box 12 are suitably radiused.

The flanges 14 and 15 may be formed in any desired manner with holes, not shown, for mounting purposes. One manner of mounting the overhead track or rail member 11 is by means of a hanger 9 suspended from the roof or supporting structure. The hanger may take the form of a clamping device for engaging with and coupling to the horizontal flange 15 of the track or rail member 11.

Figure 3:
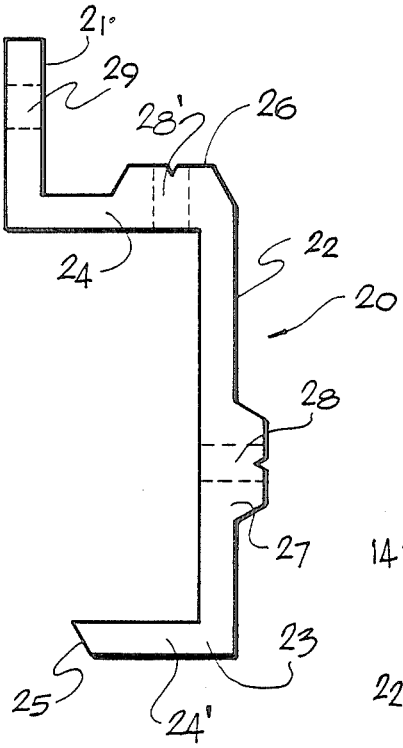
FIG. 3 is an end elevational view of the splice plate employed in the coupler shown in FIG. 1.

Referring now to FIGS. 1, 2 and 3, it can be seen that the coupler includes a pair of splice plates 20 and 20' wherein splice plate 20 comprises an elongate but relatively short member of uniform cross-section and adapted to fit about a side of the track member 11 of FIG. 1. The plate 20 comprises an upper flange 21 from which depends a U-shaped channel 22 arranged with its web 23 parallel to the flange 21 and with end flanges 24 and 24' normal thereto. The upper flange 21 extends upwardly from an end of the upper end flange 24. Inner surfaces of the channel section 22 are adapted to conform and fit closely about outer faces of the track box section 12 as shown in FIG. 1 with the lower end flange 24' terminating short of the slot 13. The edges 25 of the lower flange 24' is chamfered to provide a smooth merging with the inclined edge portions 16 and 16' respectively. A trapezoidal section rib 26 extends along an outer upper edge of the channel section of the plate channel 22 and a similar rib 27 extends along an outer surface of the web 23 and at a level slightly below a median line as shown in FIG. 3. The ribs 26 and 27 are formed at spaced intervals with threaded bores 28 for grub-screws, e.g., allen key screws not shown. The bores 28 are suitably countersunk so that the screws do not extend externally of the splice plate 20 while in use.

Each splice plate is of unitary form and is suitably integrally formed by extrusion, for example, from a high strength-to-weight ratio material such as aluminum.

The flange 21 is of height such as to fit closely between the upper track flange 15 and an upper surface of the box section 12 of a track member 11 and is formed with spaced holes 29 so that when a pair of splice plates 20 are assembled at opposite sides of a pair of abutting track members 11, as shown in FIG. 2, arranged in end-to-end alignment, bolts 30 may be passed through the holes 29 and corresponding holes formed in the flanges 14 of the member 11 to secure the pair of track members 11 in end-to-end alignment. The grub or allen screws in the bores 28 serve to clamp the end portions of the track member in position by engaging outer side and top surfaces of the box section 12 thereof.

It will be understood that the box section 12 and the slot 13 provide passage for traversing devices and suspension means such as pulleys or the like. The angular edge portions 16 and 16' maintain pulley rollers or flange edges on the track and prevents slippage into the slot.

The track system of the invention provides for close play-free fit between the splice plates 20 and the aligned track members 11 so that play-free alignment of end-to-end members 11 is obtained with facility. Abutment of the opposing track or rail member ends is indicated by numera 31. The external profile of the box-like sections formed by the pair of splice plates 20 in a splice assembly presents minimal obstruction to traversing member ropes and the like and is also convenient for storage and transport when disassembled. As a result of the section form of the track member 11 and splice plates 20, a rigid assembly is obtained with facility and track alignment problems are largely obviated. The reinforcement provided by ribs 26 and 27 strengthens and improves the load carrying and transferring capabilities of the assembly.

Although a pair of splice plates are enlarged to support the joint, a single plate may be used in certain instances. Also, the hanger 9 is only means of supporting the track or rail member and other suspension support means are contemplated by the invention.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An overhead track support system comprising a plurality of one-piece elongate track members of uniform cross-section and a plurality of splice plates of configured uniform cross-section which fit closely about an outer profile of a track member, each said track member comprising an open ended hollow section having at a lower side a central open slot extending lengthwise and from end-to-end of the member, and at an upper side a centrally located and upwardly extending upright flange extending lengthwise and from end-to-end of the member and having an upper free end, said upright flange being formed with an upper transverse flange element on the free end, wherein the upper transverse flange element and said upright flange together form the shape of a T;

a suspended hanger for mounting the track member comprising a clamping device for engaging with and coupling to the upper transverse flange element;

each said splice plate being a one-piece identically shaped profiled member of uniform cross section throughout its length;

said profiled member having a U-shaped channel section including an upright web separating a pair of transverse flanges arranged in parallel spaced apart relationship one above the other to define an upper transverse flange and a lower transverse flange in fixed spaced apart relationship to define a cavity conformal with the hollow section of the track member;

an upwardly extending connection flange carried on the end of said upper transverse flange extending parallel to and laterally of said upright web;

said lower transverse flange terminating at its free edge with an upwardly directed chamfer;

said lower transverse flange extends from said web in a lesser dimensioned distance than said upper flange;

thickening ribs of trapezoidal cross section integrally carried externally of said U-shaped channel along said upper flange adjacent said web and along said web at its mid-section between said upper and said lower transverse flanges;

attachment holes provided in said connection flange and said web rib;

fasteners insertably received in said attachment holes for bearing against the upright flange and the hollow section of the track member in releasable securement therewith;

each said splice plate comprising a high strength-to-weight ratio material;

each said splice plate being of shorter length than the track member and overlapping abutting opposing ends of the tack members;

each said splice plate fits in close relationship about the track member with the connection flange abutting the upright flange of the track member and the channel section closely fitting about the holow section of the track member, whereby a pair of said track members may be secured in end-to-end relationship by securing a pair of said splice plates in overlapping relationship with respect to abutted ends of the track member and at opposite sides thereof.

* * * * *